US008783398B2

(12) United States Patent
Wlezien

(10) Patent No.: US 8,783,398 B2
(45) Date of Patent: Jul. 22, 2014

(54) REPLACEABLE COOLING SYSTEM COMPARTMENT DOOR SCREEN INSERT

(75) Inventor: Christopher Michael Wlezien, Chicago, IL (US)

(73) Assignee: Caterpillar Inc., Peoria, IL (US)

( * ) Notice: Subject to any disclaimer, the term of this patent is extended or adjusted under 35 U.S.C. 154(b) by 190 days.

(21) Appl. No.: 13/410,598

(22) Filed: Mar. 2, 2012

(65) Prior Publication Data

US 2013/0228291 A1 Sep. 5, 2013

(51) Int. Cl.
*B60K 11/08* (2006.01)

(52) U.S. Cl.
USPC ..... 180/68.1; 296/146.1

(58) Field of Classification Search
USPC ..... 180/68.1; 296/146.1, 146.5
See application file for complete search history.

(56) References Cited

U.S. PATENT DOCUMENTS

| | | | | | |
|---|---|---|---|---|---|
| 1,862,684 | A | | 6/1932 | Kellogg | |
| 3,921,603 | A | * | 11/1975 | Bentz et al. | 123/41.33 |
| 4,094,099 | A | * | 6/1978 | Birch | 49/163 |
| 4,160,487 | A | * | 7/1979 | Kunze et al. | 180/68.4 |
| 4,186,817 | A | * | 2/1980 | Bauer | 180/68.1 |
| 4,592,437 | A | | 6/1986 | Holm et al. | |
| 5,215,157 | A | | 6/1993 | Teich | |
| 5,676,197 | A | | 10/1997 | Diebold et al. | |
| 5,794,733 | A | * | 8/1998 | Stosel et al. | 180/68.1 |
| 6,167,976 | B1 | * | 1/2001 | O'Neill et al. | 180/69.2 |
| 6,634,448 | B2 | * | 10/2003 | Bland | 180/68.1 |
| 6,655,486 | B2 | * | 12/2003 | Oshikawa et al. | 180/68.1 |
| 7,204,329 | B2 | * | 4/2007 | Pfohl et al. | 180/68.3 |
| 7,370,718 | B2 | * | 5/2008 | Witwer et al. | 180/69.2 |
| 7,448,668 | B2 | * | 11/2008 | Brabeck et al. | 296/146.1 |
| 7,581,607 | B2 | * | 9/2009 | Moen et al. | 180/68.6 |
| 7,766,111 | B2 | * | 8/2010 | Guilfoyle et al. | 180/68.1 |
| 7,784,576 | B2 | * | 8/2010 | Guilfoyle et al. | 180/68.1 |
| 7,946,367 | B2 | * | 5/2011 | Good | 180/68.1 |
| 8,056,302 | B2 | | 11/2011 | Uto et al. | |
| 8,230,957 | B2 | * | 7/2012 | Braun et al. | 180/68.1 |
| 8,347,994 | B2 | * | 1/2013 | Bering et al. | 180/68.3 |
| 8,418,790 | B2 | * | 4/2013 | Dauderman et al. | 180/68.1 |
| 2004/0216934 | A1 | | 11/2004 | Tomiyama et al. | |
| 2005/0217911 | A1 | | 10/2005 | Cheng | |
| 2005/0279548 | A1 | | 12/2005 | Kurtz, Jr. et al. | |
| 2006/0055208 | A1 | | 3/2006 | Troton | |
| 2006/0202506 | A1 | * | 9/2006 | Brabeck et al. | 296/146.1 |
| 2007/0221340 | A1 | | 9/2007 | Aaron et al. | |
| 2007/0272459 | A1 | * | 11/2007 | Moen et al. | 180/68.1 |
| 2009/0066096 | A1 | | 3/2009 | Doroghazi et al. | |
| 2009/0188734 | A1 | * | 7/2009 | Braun et al. | 180/68.1 |
| 2013/0228291 | A1 | * | 9/2013 | Wlezien | 160/107 |

FOREIGN PATENT DOCUMENTS

| | | |
|---|---|---|
| CN | 101749100 | 6/2010 |
| DE | 28 17 948 | 10/1979 |

* cited by examiner

*Primary Examiner* — Jeffrey J Restifo
(74) *Attorney, Agent, or Firm* — Miller, Matthias & Hull

(57) ABSTRACT

An improved cooling system compartment door for a landfill compactor is provided. The door comprises a door frame and a replaceable screen insert. The screen insert is configured so that it can be used in either a left side or right side cooling system compartment door frame. The screen insert can be easily replaced when the screen is damaged or clogged, thereby saving time, materials and expense. The screen insert is particularly suited for use with landfill compactor machines which operate in debris laden environments which can damage the ventilation screens.

7 Claims, 4 Drawing Sheets

REPLACEABLE COOLING SYSTEM COMPARTMENT DOOR SCREEN INSERT

TECHNICAL FIELD

This disclosure relates generally to cooling system compartment doors found on some off-road machines. More particularly, this disclosure relates to a cooling system compartment door having a replaceable screen insert, primarily for use with landfill compactors.

BACKGROUND

Off-road machines of the kind referred to herein typically comprise a support structure mounted on wheels, an operator control station (cab), a work implement, an engine compartment that houses a power system, and a cooling system compartment aft of the engine compartment and separated therefrom by a sound wall. The cab, work implement, engine compartment and cooling system compartment are mounted on the support structure. The cooling system compartment houses a radiator cooling system and is accessible via doors mounted on both sides of the compartment. Typically each cooling system compartment door is equipped with a built in ventilation screen for allowing fresh air to flow through the cooling system compartment.

Off-road machines are exposed to a significant amount of debris, particularly when used in landfill operations. The ventilation screens on the cooling system compartment doors can be subject to damage or clogging from loose debris pulled into the screen, thereby interrupting or lessening cooling airflow to the radiator package within. In addition, debris can puncture the screen, allowing undesired materials to enter the cooling system compartment. Since conventional cooling system compartment doors are manufactured as a single piece with built in ventilation screens, damage to the ventilation screen requires replacement of the entire cooling system compartment door.

The present disclosure is directed to one or more of the problems or shortcomings set forth above.

SUMMARY OF THE DISCLOSURE

It would therefore be beneficial to provide a cooling system compartment door having a replaceable ventilation screen.

It would also be beneficial to provide a single ventilation screen that can be installed on either a left side or right side cooling system compartment door.

These and other objectives are achieved by the invention as described below and in drawings hereto.

In accordance with one aspect of the present disclosure, there is provided a cooling system compartment door for use with an off-road machine such as a landfill compactor. The cooling system compartment door comprises a door frame intended to be permanently installed on the landfill compactor and a replaceable screen insert. The door frame may be hung on hinges and has a substantially frame-like configuration defining a central opening. The door frame includes a door handle and fastening members affixed to the door frame for receiving the screen insert. The screen insert is removably mounted to the door frame via the fastening members, is sized to cover the central opening, and comprises a relatively flexible screen mounted to a relatively rigid screen support. The screen insert is symmetrical about a horizontal axis so that it can be inverted to fit either a left side door frame or a right side door frame.

Preferably the flexible screen comprises a perforated, corrugated portion having two vertical edges and defining a cutout section communicating with one vertical edge and sized to accommodate the door handle. The screen further comprises flat vertical flanges extending outward from either vertical edge of the corrugated portion that enable the screen to be spot welded or otherwise affixed to the screen support.

The screen support comprises as an array of slats (generally, elongated strips of metal) that provide rigidity to the screen insert. In one particular embodiment the screen support comprises fifteen pieces or slats: two short vertical slats, one long vertical slat, six comb-shaped slats and six horizontal slats, although the number of pieces can vary. Basically each slat is a thin, narrow flat strip of metal, typically three millimeters thick.

The two short vertical slats and the long vertical slat form the two vertical sides of the screen support. The short vertical slats are arranged in vertical alignment with each other on the "handle side" of the screen insert, with one of the short vertical slats extending from the top of the screen insert to the handle cutout and the other of the short vertical slats extending from the bottom of the screen insert to the handle cutout. The two short vertical slats are affixed to the flanges of the screen on the handle side. The long vertical slat extends from the top of the screen insert to the bottom of the screen insert and is affixed to the other side ("hinge side") of screen flange in parallel relationship to the short vertical slats, thereby forming the left and right sides of the screen support.

The comb-shaped slats are spaced apart and arranged along substantially the entire height of the screen insert and extend horizontally from the left side to the right side of the screen support. Each comb-shaped slat has a free flat edge and a fluted or serrated edge that mates with the corrugated portion of the screen. Each comb-shaped slat is affixed to the long vertical slat and one of the short vertical slats. An equal number of substantially rectangular horizontal slats are oriented orthogonally to the comb-shaped slats and affixed thereto.

The other major part of the cooling compartment door, the door frame, may be made from a single metal sheet that is cut and formed to the desirable shape. Typically the door frame comprises a substantially flat body portion defining the central opening and a sidewall extending substantially perpendicularly from the peripheral edges of the body portion. Ordinarily the body portion is a single piece, but may be thought of as having a top horizontal member, a bottom horizontal member and first and second vertical members extending between the top and bottom horizontal members to form a frame-like structure defining a large central opening.

The door frame should be configured to fit the specific geometry of the machine with which it is used. For example, in one application the bottom horizontal member has a bottom edge having a segment that is angled upward to accommodate the specific geometry of one particular landfill compactor.

In another aspect of the invention a landfill compactor is provided comprising a support structure mounted on compacting wheels, an operator control station and a cooling system compartment mounted on the support structure, the cooling system compartment having left and right side doors, each cooling system compartment door comprising a left side door frame or right side door frame, each door frame having a top, a bottom and a substantially frame-like configuration defining a central opening disposed in the door frame between the top and bottom, the left and right side doorframes being mirror images of each other but not identical, and a screen insert comprising a screen mounted to a screen support. The screen insert is symmetrical about a horizontal axis and may be removably mounted to either the left side or right side door frame so that it extends over the entire opening.

In still another aspect of the invention a replaceable cooling system compartment screen insert installable in either the left side or right side cooling system compartment door of a landfill compactor is provided. The screen insert has a height and width and comprises a screen support comprising an array of slats and holes disposed in the slats for receiving fastening members, and a screen mounted to the screen support. The screen may comprise a perforated, corrugated portion having two vertical edges and defining a cutout section communicating with one vertical edge and sized to accommodate a door handle. The screen further comprises flat vertical flanges extending outward from either vertical edge of the corrugated portion, wherein the flat vertical flanges are affixed to the screen support.

DETAILED DESCRIPTION

While this invention may be embodied in many forms, there is shown in the figures and will herein be described in detail one or more embodiments, with the understanding that this disclosure is to be considered an exemplification of the principles of the invention and is not intended to limit the invention to the illustrated embodiments.

Figure 1:
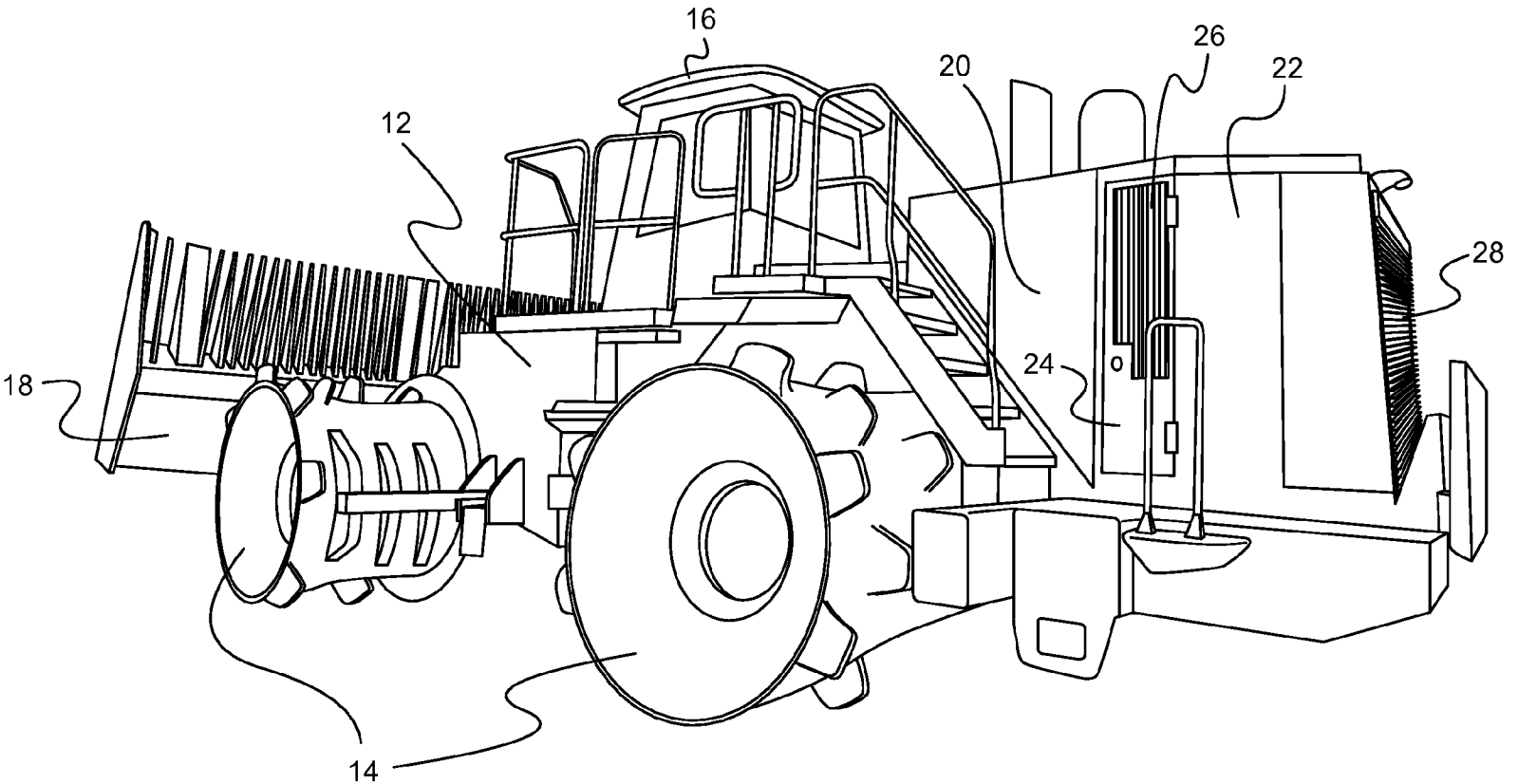
Fig. 1 (Prior Art)
FIG. 1 is a left side perspective view of a landfill compactor having conventional cooling system compartment doors.

Turning to the drawings, there is shown in FIG. 1 a perspective view of a work machine equipped with conventional cooling system compartment doors. The work machine may be a landfill compactor 10, as shown, or any other on-highway or off-highway machine in which the cooling system compartment doors are exposed to debris or otherwise subject to damage. In the illustrated embodiment, the landfill compactor 10 includes a support structure 12 mounted on compacting wheels 14, an operator control station (cab) 16, a work implement 18 (in the illustration, a front blade), an engine compartment 20 that houses a power system and a cooling system compartment 22 aft of the engine compartment. The cab 16, work implement 18 engine compartment 20 and cooling system compartment 22 are mounted on the support structure 12.

The cooling system compartment 22 houses a radiator package (not shown) and is accessible via one of two cooling system compartment doors 24 installed on either side of the cooling system compartment 22. Each door 24 is provided with a permanent, built in ventilation screen 26 for allowing fresh air to pass through the cooling system compartment 22. The door 24 and screen 26 are a single piece, and so must be replaced together if the screen 26 is damaged.

The screen 26 typically is made of corrugated metal that has been perforated to allow air flow into and out of the cooling system compartment. The screen 26 may extend partway down the door 24 (like the partial screen 26 shown in FIG. 1) or the entire door height.

Landfill compactors 10 typically have a cooling system compartment door 24 on each side, each having a ventilation screen 26, and a third (exit) screen 28 located in the rear wall of the cooling system compartment 26 (behind the radiator package) to provide flow through ventilation. The left side door 24 and right side door (not visible in FIG. 1) are minor images of each other. A fan (not shown) located inside the cooling system compartment 22 draws cooling air from the outside through the door screens 26 and into the cooling system compartment 22 that houses the radiator package. The air then passes through the exit screen 28 in the rear of the cooling system compartment 22.

Off-road machines like the one shown in FIG. 1 can be exposed to a significant amount of debris, particularly when used in landfill applications. As a result, the ventilation screens 26 can be subject to clogging from loose debris pulled into the screens 26, which can interfere with the flow of cooling air to the cooling system compartment 22.

One solution to clogged screens 26 is to reverse the fan periodically to blow out any debris clogging the screens 26. However eventually the screens 26 can become too damaged for proper use. For instance, debris can puncture the screens 26, allowing undesired dirt, debris and other materials to enter the cooling system compartment 22.

Since conventional cooling system compartment doors 24 are manufactured as a single piece with built in (non-removable) ventilation screens 26, damage to the ventilation screen 26 requires replacement of the entire door 24, which is costly and time consuming.

The present invention solves this problem by providing a cooling system compartment door having a replaceable screen insert. The screen insert is not only replaceable, but it can be installed on either the left side door or right side door as will be explained.

Figure 2:
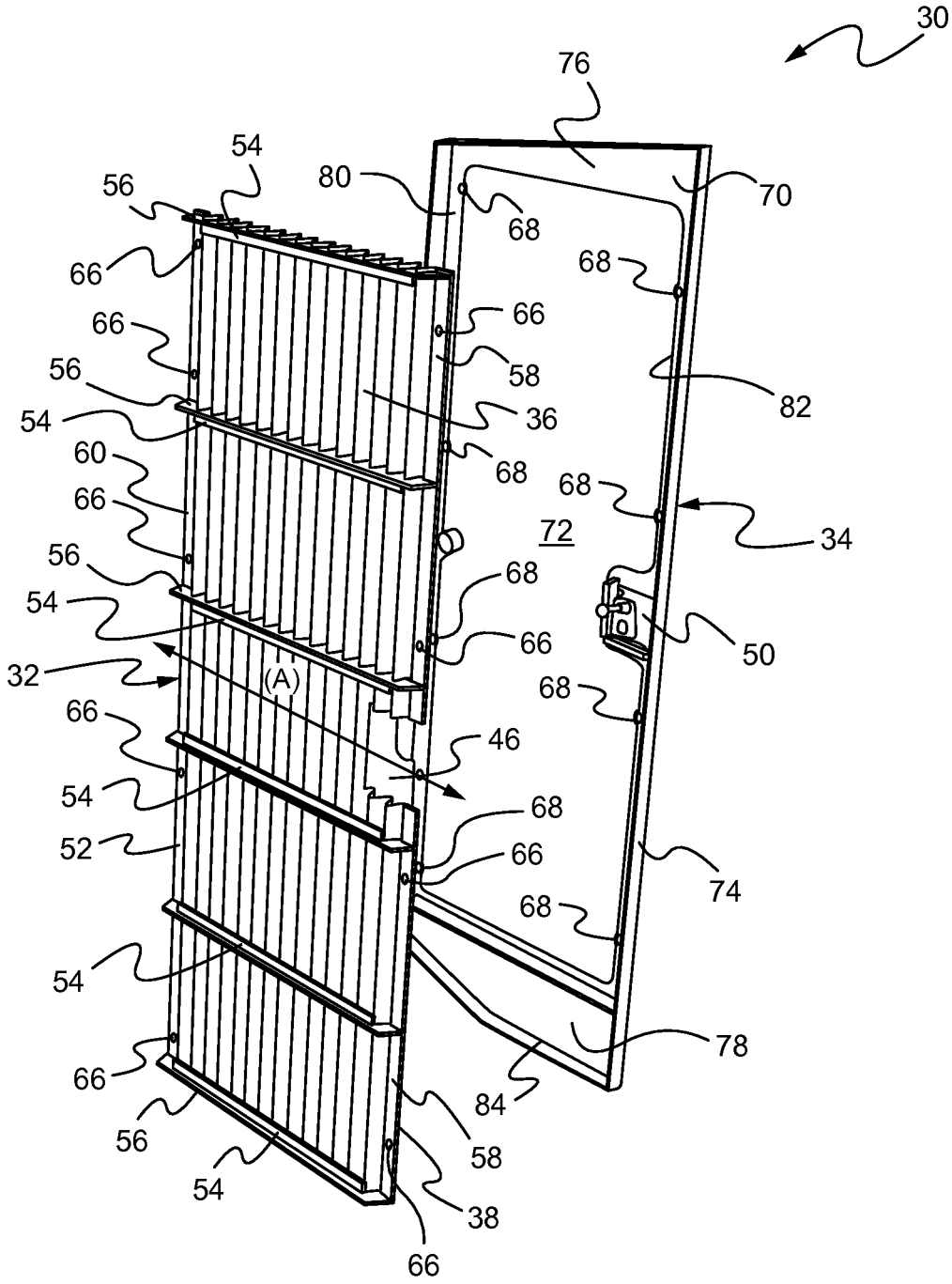
FIG. 2 is an exploded view of a cooling system compartment door according to the present invention for the right side of a landfill compactor, prior to mounting the screen insert to the door frame.

Turning to FIG. 2 there is shown an exploded view of an exemplary cooling system compartment door 30 according to the present invention. The door 30 comprises a separate, replaceable screen insert 32 (shown on the left side of the figure) mounted to a door frame 34 (shown on the right side of the figure).

The screen insert 32 can be manufactured and sold as a stand alone replacement part or as a component of an original cooling system compartment door 30. Each screen insert 32 comprises a relatively soft (flexible) screen 36 and a relatively rigid screen support 38, each of which will now be described in more detail.

Figure 4:
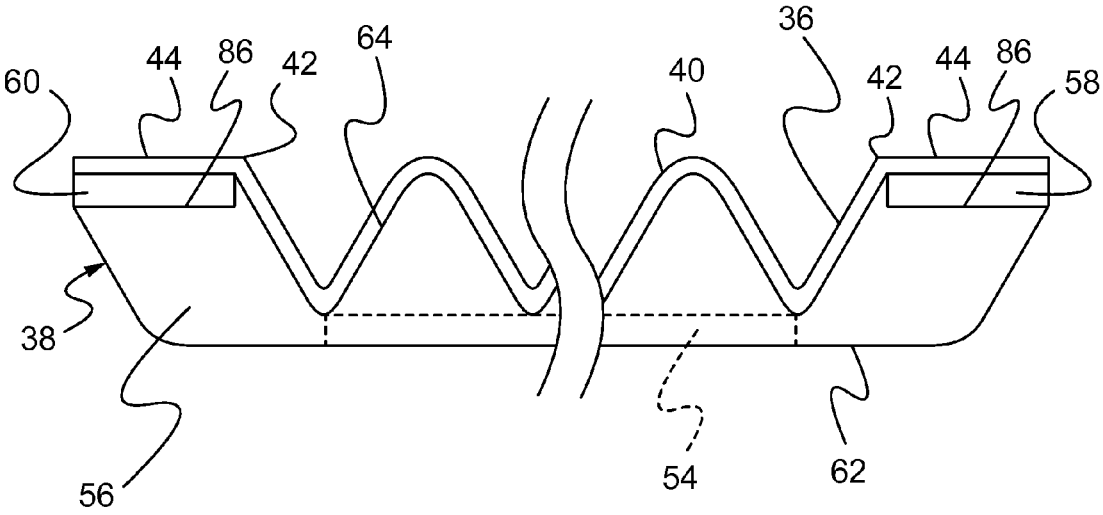
FIG. 4 is a top plan view of the screen insert of FIG. 2.

The screen 36 may comprise a thin, perforated metal sheet shaped into a corrugated configuration as shown in FIGS. 2 and 4. As perhaps best shown in the top view provided in FIG. 4, the screen 36 includes a corrugated portion 40 having vertical edges 42 and flat, vertical flanges 44. The flanges 44 extend outward from the vertical edges 42 of the corrugated portion 40 to enable the screen 36 to be spot welded onto the screen support 38 as explained further below.

The screen 36 is substantially rectangular and defines a cut out 46 along one side equidistant the top and bottom of the screen insert 38 for accommodating a door handle 50. The corrugated shape provides for a larger surface area for a given height and width, which means the screen 36 can build up significantly more debris before it has to be cleaned by reversing the engine fan or before the screen insert 32 has to be replaced. Also, the corrugated shape prevents screen plugging when large pieces of debris (such as paper or plastic bags) get drawn to the door 30, since the corrugated flutes keep the debris off of much of the recessed surface area of the screen 36.

The screen support 38 comprises an array of slats 52 that form a relatively rigid structure on which the relatively flexible screen 36 may be mounted. For example, the array 52 illustrated in FIG. 2 comprises six rectangular horizontal slats or members 54, each defining a plane oriented perpendicular to the ground, six comb-shaped slats or members 56, each defining a plane oriented parallel to the ground (and thus perpendicular to the rectangular horizontal slats 54), two short (door handle side) vertical slats 58 and one long (hinge side) vertical slat 60.

The short and long vertical slats 58, 60 are substantially rectangular and whose lateral spacing defines the width of the screen support 38, and thus the width of the screen insert 32. Each of the two short vertical slats 58 on the door handle side extends from either the top or bottom of the screen insert 32 to the space or cutout 46 for the door handle assembly 50. The longer, hinge side vertical slat 60 extends the entire height of the screen insert 32.

Referring to FIGS. 2 and 4, the horizontal slats 54 are substantially rectangular and may have a length approximately equal to the distance between the leftmost and rightmost vertical flute of the corrugated screen 36. The comb-shaped slats 56 have a free flat edge 62 and a fluted edge 64 that mates with the corrugated portion 40 of the screen 36. The comb-shaped slats 56 extend horizontally from the long vertical slat 60 to one of the opposing short vertical slats 58 and are welded thereto.

The horizontal slats 54 and the comb-shaped slats 56 are welded together and spaced apart along the entire height of the screen insert 32 to provide stabilizing support for the entire screen 36.

Preferably the slats 54, 56, 58, 60 that make up the screen support 38 are may made from 3 mm thick steel, although any suitable material and thickness may be used. The slats 54, 56, 58, 60 are welded together or otherwise affixed to each other to provide a screen support 38 having enough rigidity to withstand shipping and installation without significant bending.

An array of holes or apertures 66 may be drilled or otherwise formed in the screen support 38 and, more particularly, in the short and long vertical slats 58, 60 at spaced apart locations to accommodate weld studs, bolts or other fasteners 68 extending from the door frame 34 when the screen insert 32 and door frame 34 are assembled. Preferably the array of holes 66 is arranged symmetrically about horizontal axis (A) located equidistant the top and bottom of the screen insert 32.

The assembled screen insert 32 has an inwardly facing side and an outwardly facing side. The inwardly facing side faces the interior of the cooling system compartment 22 and is the side on which the comb-shaped slats 56 are located. The outwardly facing side faces the door frame 34 and the exterior.

The substantially planar screen insert 32 is rotationally symmetrical about a horizontal axis (A) which, as explained below, allows the same screen insert 32 to fit either a left side or right side door frame 34, 34'.

Figure 3:
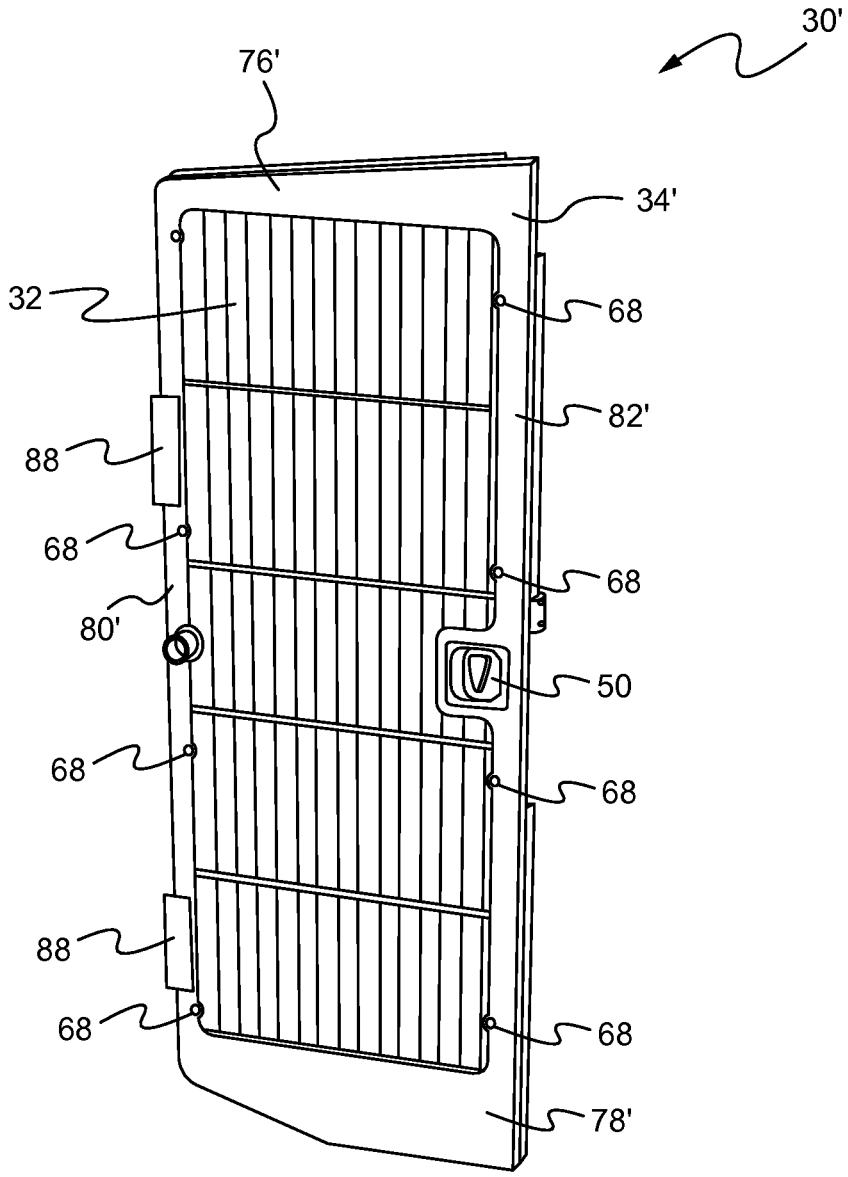
FIG. 3 is a perspective view of an assembled cooling system compartment door according to the present invention for the left side of a landfill compactor.

Referring to FIGS. 2 and 3, the door frame 34 may be made from a single metal sheet that is cut and formed into a substantially rectangular frame-like configuration having a substantially flat body portion 70 defining a central opening 72 and a sidewall 74 extending substantially perpendicularly from the body portion 70 along its periphery. More particularly, the door frame 34 may comprise a top horizontal member 76, a bottom horizontal member 78, a first (hinge-side) vertical member 80 extending between one set of respective ends of the top and bottom horizontal members 76, 78, and a second (handle side) vertical member 82 extending between the other set of respective ends of the top and bottom horizontal members 76, 78. Preferably the central opening 72 has a top and bottom and is substantially rectangular and symmetrical about a horizontal axis intersecting the door handle 50, so that the door handle 50 in turn is equidistant the top and bottom of the central opening 72.

The door frame 34 may be configured to any desirable shape and, most practicably, to a shape that fits the specific geometry of the machine with which it will be used. For example, in the illustrated embodiment the top horizontal member 76 is trapezoidal shaped and the bottom horizontal member 78 has a bottom edge 84 that is bent, i.e., angled upward along one segment. It should be understood however that the overall shape and dimensions of the door frame 34, and thus the door 30, will be determined by the specific requirements of the off-road vehicle for which it is used.

Method of Manufacture of the Cooling System Compartment Door 30

The cooling system compartment door 30 of the present invention, comprising a screen insert 32 and door frame 34, may be manufactured and assembled as follows, it being understood that this is just an exemplary method of construction and that the steps need not be done in the order set forth below.

Step 1: Manufacturing the Screen Insert 32

The screen 36 may be manufactured by placing a flat perforated metal sheet on a laser cutter and cutting it to the desired size and shape, including the handle cutout 46. The metal sheet may be thin enough (e.g., about one millimeter thick steel sheet) to be hand deformable. However, any suitable material may be used, including mesh or netting material. The flat, cut metal sheet is then placed in a corrugation machine which folds it into a corrugated shape, preferably one having a corrugated portion 40 and flat flanges 44 extending from either vertical edge 42 of the corrugated portion 40.

The screen support 38 may be manufactured by taking 3 mm metal plate and cutting the two short vertical slats or members 58, the long vertical slat or member 60, the six horizontal slats or members 54 and the six comb-shaped slats or members 56. Again, the number of slats may vary according to need.

Next, the long vertical slat 60 is placed onto the screen 36 and aligned with the flange 44 opposite the handle cutout 46 and spot welded thereto. Similarly, the two short vertical slats 58 are placed onto the screen 36 and aligned with the flange 44 on the handle cutout 46 side and spot welded thereto.

The six comb-shaped slats 56 are laid on top of the screen 36 so that they mate with the corrugated portion 40 of the screen 36 as shown in FIG. 4. When mated with the corrugated screen 36 the comb-shaped slats 56 are standing upright, that is, perpendicular to the plane defined by the screen 36 with their fluted edges 64 abutting the corrugated screen 36 in mating relationship therewith. One flat screen facing edge 86 of each comb-shaped slat 56 is fillet welded to the long vertical slat 60 and the other flat (screen facing) edge 86 of each comb-shaped slat 56 is fillet welded to one of the short vertical slats 58.

Next, the six horizontal slats 54 are positioned so that they lay across the corrugated screen 36 with one major surface contacting the screen 36 and one longitudinal edge abutting a comb shaped slat 56 and fillet welded thereto.

Preferably the three topmost horizontal slats 54 (located on the upper half of the screen insert 32 above the door handle cutout 46) are positioned directly under their corresponding comb-shaped slats 56 so that the top edges of the horizontal slats 54 abut the underside of the comb-shaped slats 56, while the three bottommost horizontal slats 54 are positioned directly above their corresponding comb-shaped slats 56 so that the bottom edges of the horizontal slats 54 abut the top side of the comb-shaped slats 56.

The screen 36 may be spot welded in places to the horizontal slats 54.

Step 2: Manufacturing the Door Frame 34

The door frame 34 may be made from three millimeter thick plate steel to provide the necessary rigidity, since the rigidity of the cooling system compartment door 30 is provided primarily by the door frame 34.

Hinge members 88 may be affixed to the door frame 34 and, more particularly, to the first vertical member 80. The door handle assembly 50 may be installed onto the second vertical member 82.

A plurality of weld studs, bolts or similar fasteners 68 may be welded or otherwise affixed to and spaced around the door frame 34 in an arrangement that is symmetrical about a horizontal axis so that they line up with the holes 66 in the screen insert 32. The fasteners 68 provide a means for mounting the screen insert 32 to the door frame 34 as explained in Step 3.

Step 3: Mounting the Screen Insert 32 to the Door Frame 34

The final step in manufacturing and assembling a door 30 is to mount the assembled screen insert 32 to the door frame 34. This is done by positioning the screen insert 32 next to the door frame 34 so that holes 66 in the screen insert 32 align with the weld studs 66 projecting from the door frame 34, then sliding the screen insert 32 onto the weld studs 66. Nuts or other fastening means are then affixed to the weld studs to secure the screen insert 32 to the door frame 34. The assembled door frame 34 is then ready for installation on a landfill compactor or other vehicle.

Replacing a Damaged Screen

In a landfill compactor equipped with doors 30 made according to the present invention, when a screen 36 is damaged the screen insert 32 can be replaced instead of replacing the entire door 30. To replace a screen insert 32 having a damaged screen 36, the cooling system compartment door 30 is opened by unlatching the door 30 and pivoting it on its hinges 88. Then the damaged screen insert 32 is removed from the door frame 34 by unthreading or otherwise removing the nuts or other fasteners from the weld studs 68 on which the screen insert 32 is mounted.

Next, a new screen insert 32 is mounted to the existing door frame 34 by aligning the holes (openings) 66 in the screen support 38 with the weld studs 68 extending from the door frame 34, sliding the screen insert 32 onto the weld studs 68, and then fastening the nuts or other fasteners onto the weld studs 68. The door frame 34 need not ever be removed from the work machine 10.

The Same Screen Insert 32 Fits Either Side of the Cooling System Compartment FIG. 3 is a perspective view of a left side cooling system compartment door 30' according to the invention. The heads of the weld studs 68 which are affixed to and extend from the door frame 34' on its interior (cooling compartment facing) side are apparent from this exterior (outside) view. The screen insert 32—identical to that shown in FIG. 2 but now inverted—is mounted onto the weld studs 68 and held in place by nuts or other fasteners (not shown). When installed onto the door frame 34' the screen insert 32 covers the central opening 72 defined by the door frame 34'.

The right side door frame 34 shown in FIG. 2 and the left side door frame 34' shown in FIG. 3 are not identical. Rather, they are mirror images of each other and are not themselves interchangeable. Nevertheless, the same screen insert 32 will fit both door frames 34, 34'.

This versatility is the result of a number of factors. First, unlike the conventional "partial" screen 26 shown in FIG. 1, the screen insert 32 of the present invention shown in FIGS. 2 and 3 is a full screen insert in that it is designed to extend substantially the entire height of the cooling system compartment door 30. Second, as noted above, the screen insert 32 is symmetrical about a horizontal axis (A). Third, the door handle 50 is located equidistant the top and bottom of the central opening 72. Finally, the fasteners 68 are strategically located around the door frame 34 so that the screen insert 32 fits over the fasteners 68 when the screen insert 32 is in either an up or down orientation. More specifically, although the door frames 34 themselves may not be symmetrical about a horizontal axis, the arrangement (locations) of the fasteners 68 are symmetrical about a horizontal axis equidistant the top and bottom of the central opening 72. Because of these four factors, the screen insert 32 of the present invention will fit either a right side door frame 34 (FIG. 2) or a left side door frame 34' (FIG. 3) by simply inverting the screen insert 32 (i.e., rotating it 180 degrees about the (A) axis). Thus the present invention avoids the necessity of having to manufacture and stock replacement left and right side door frames 34', 34, since usually only the screen insert 32 will need to be replaced, and not the door frame 34, 34'.

Thus there has been described a cooling system compartment door 30 comprising a door frame 34 and a separate replaceable screen insert 32. The screen insert 32 is configured so that it can be used in either a left or right side engine door frame 34', 34. The screen insert 32 can be easily replaced when the screen 36 is damaged or clogged, thereby saving time, materials and expense. The screen insert 32 is particularly suited for use with landfill compactor machines 10 which operate in debris laden environments.

The present invention is intended for use in off-road machines requiring cooling system compartment doors with ventilation screens. The invention is particularly suitable for use with landfill compactors equipped with cooling system compartment doors on either side of the cooling system compartment and in which the cooling system compartments doors are exposed to significant amounts of debris. It should be understood, however, that the invention may be useful on other off-road machines as well.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A cooling system compartment door for use with an off-road machine, the door comprising:

a door frame comprising a body and fastening members extending from the body, the body having a substantially frame-like configuration defining a central opening having a top and bottom; and a screen insert having a top and a bottom and sized to cover the central opening and comprising a screen mounted to a screen support, the screen support comprising an array of slats and holes disposed in the array of slats for receiving the fastening members;

wherein the screen insert is removably mounted to the door frame, wherein the screen insert is symmetrical about a horizontal axis, the door handle is located equidistant the top and bottom of the central opening and the fastening members are arranged symmetrically about a horizontal axis equidistant the top and bottom of the central opening.

2. A cooling system compartment door for use with an off-road machine, the door comprising:

a door frame comprising a body and fastening members extending from the body, the body having a substantially frame-like configuration defining a central opening having a top and bottom; and a screen insert having a top and a bottom and sized to cover the central opening and comprising a screen mounted to a screen support, the screen support comprising an array of slats and holes disposed in the array of slats for receiving the fastening members;

wherein the screen insert is removably mounted to the door frame, wherein the screen comprises a perforated, corrugated portion having two opposing vertical edges, the corrugated portion defining a cutout communicating with one vertical edge and sized to accommodate a door handle, the cutout being equidistant the top and bottom of the screen insert, the screen further comprising a flange extending outward from each vertical edge of the corrugated portion, wherein the flanges are affixed to the screen support, and wherein the array of slats comprises:

two short, substantially rectangular, vertical slats arranged in vertical alignment to each other, one of said short vertical slats extending from the top of the screen insert to the cutout, the other of said short vertical slats extending from the bottom of the screen insert to the cutout, said short vertical slats being affixed to the one of the flanges;

one long, substantially rectangular, vertical slat extending from the top of the screen insert to the bottom of the screen insert, said long vertical slat being affixed to the other flange parallel to the short vertical slats thereby forming left and right sides of the screen support;

a plurality of spaced apart comb-shaped slats arranged vertically along substantially the entire height of the screen insert and extending horizontally from the left side to the right side of the screen support, each comb-shaped slat having a free flat edge and a fluted edge that mates with the corrugated portion of the screen, each comb-shaped slat being affixed to the long vertical slat and one of the short vertical slats.

3. The cooling system compartment door of claim 2 wherein the array of slats further comprises a plurality of substantially rectangular horizontal slats, each horizontal slat being affixed to a comb-shaped slat.

4. The cooling system compartment door of claim 3 wherein the door frame further comprises:

a substantially flat body defining the central opening; and a sidewall extending substantially perpendicularly from the body along its periphery.

5. The cooling system compartment door of claim 4 wherein the door frame body comprises:

a top horizontal member;

a bottom horizontal member;

a first vertical member extending between the top and bottom horizontal members; and a second vertical member extending between the top and bottom horizontal members.

6. The cooling system compartment door of claim 5 wherein the bottom horizontal member has a bottom edge having a segment that is angled upward.

7. A screen insert installable on a left side or right side cooling system compartment door of a landfill compactor, the screen insert having a height and width and comprising:

a screen support comprising an array of slats and holes disposed in the slats for receiving fastening members; and a screen mounted to the screen support, the screen comprising a perforated, corrugated portion having two opposing vertical edges and defining a cutout section communicating with one vertical edge and sized to accommodate a door handle, the screen further comprising flat vertical flanges extending outward from either vertical edge of the corrugated portion, wherein the flanges are affixed to the screen support, wherein the array of slats comprises:

two short, substantially rectangular, vertical slats arranged in vertical alignment to each other, one of said short vertical slats extending from the top of the screen insert to the cutout section, the other of said short vertical slats extending from the bottom of the screen insert to the cutout section, said short vertical slats being affixed to the screen flanges;

one long, substantially rectangular, vertical slat extending from the top of the screen insert to the bottom of the screen insert, said long vertical slat being affixed to a screen vertical flange parallel to the short, substantially rectangular, vertical slats, thereby forming left and right sides of the screen support;

a plurality of spaced apart comb-shaped slats arranged along substantially the entire height of the screen insert and extending horizontally from the left side to the right side of the screen support, each comb-shaped slat having a free flat edge and a fluted edge that mates with the corrugated portion of the screen, each comb-shaped slat being affixed to the long vertical slat and one of the short vertical slats; and a plurality of substantially rectangular horizontal slats, each rectangular horizontal slat being affixed to a comb-shaped slat.

* * * * *